US011124386B2

(12) United States Patent
Fargo et al.

(10) Patent No.: US 11,124,386 B2
(45) Date of Patent: Sep. 21, 2021

(54) SAFETY BRAKE CONFIGURATION FOR ELEVATOR APPLICATION

(71) Applicant: OTIS ELEVATOR COMPANY, Farmington, CT (US)

(72) Inventors: Richard N. Fargo, Plainville, CT (US); Duan Liang, Farmington, CT (US); Tahany Ibrahim El-Wardany, Bloomfield, CT (US); James M. Draper, East Hartland, CT (US); Xiaodong Luo, South Windsor, CT (US); Joe J. Liou, South Windsor, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 167 days.

(21) Appl. No.: 15/244,703

(22) Filed: Aug. 23, 2016

(65) Prior Publication Data

US 2017/0057783 A1 Mar. 2, 2017

Related U.S. Application Data

(60) Provisional application No. 62/209,433, filed on Aug. 25, 2015.

(51) Int. Cl.
*B66B 5/16* (2006.01)
*B66B 5/18* (2006.01)
(Continued)

(52) U.S. Cl.
CPC ..... *B66B 5/16* (2013.01); *B66B 5/18* (2013.01); *B66B 9/00* (2013.01); *B66B 11/0213* (2013.01)

(58) Field of Classification Search
CPC ..... B66B 9/00; B66B 5/16; B66B 11/0213; B66B 5/18; B66B 11/022
See application file for complete search history.

(56) References Cited

U.S. PATENT DOCUMENTS 416,000 A 11/1889 Hatch
495,554 A 4/1893 Hern
(Continued)

FOREIGN PATENT DOCUMENTS

CN 103459290 A 12/2013
DE 112012006051 T5 12/2014
(Continued)

OTHER PUBLICATIONS

European Extended Search Report dated Feb. 13, 2017, issued in the corresponding European Patent Application No. 16185779.2.
(Continued)

*Primary Examiner* — Diem M Tran
(74) *Attorney, Agent, or Firm* — Bachman & LaPointe, P.C.

(57) ABSTRACT

An adjacent safety configuration for an elevator includes a second pair of safeties displaced from a first pair of safeties by at least 0.1 seconds of travel time at a rated speed of the elevator. An adjacent safety configuration for an elevator including a second pair of safeties displaced from the first pair of safeties to provide a predetermined time period before the second pair of safeties pass over a point on a guide rail previously passed over by the first pair of safeties to permit the guide rail surface to decrease by a predetermined temperature. A method of spacing an adjacent safety configuration for an elevator system including de-rating a pair of trailing safeties with respect to a pair of leading safeties
(Continued)

as a function of a rated speed of the elevator and a spacing between the pair of trailing safeties and the pair of leading safeties.

10 Claims, 6 Drawing Sheets

(51) Int. Cl.
*B66B 11/02* (2006.01)
*B66B 9/00* (2006.01)

(56) References Cited

U.S. PATENT DOCUMENTS

| | | | | |
|---|---|---|---|---|
| 1,670,779 | A | 5/1928 | Milks | |
| 5,301,773 | A * | 4/1994 | Jamieson | B66B 5/22 187/376 |
| 6,161,653 | A | 12/2000 | Skalski et al. | |
| 6,981,575 | B2 | 1/2006 | Barker et al. | |
| 8,157,061 | B2 | 4/2012 | Gremaud et al. | |
| 8,550,217 | B2 | 10/2013 | Valjus et al. | |
| 9,663,327 | B2 | 5/2017 | Terry et al. | |
| 9,988,240 | B2 * | 6/2018 | Anderson | B66B 5/16 |
| 2008/0135345 | A1 | 6/2008 | Kocher et al. | |
| 2012/0037462 | A1 * | 2/2012 | Urben | B66B 11/0206 187/401 |
| 2014/0008157 | A1 | 1/2014 | Terry et al. | |
| 2014/0224594 | A1 | 8/2014 | Billard et al. | |

FOREIGN PATENT DOCUMENTS

| | | | | |
|---|---|---|---|---|
| GB | 2274827 | A | | 8/1994 |
| GB | 2369102 | A | | 5/2002 |
| JP | H07206310 | A | | 8/1995 |
| JP | 2002302360 | A | * | 10/2002 |
| JP | 2011126681 | A | * | 6/2011 |
| WO | 2011006287 | A1 | | 1/2011 |
| WO | 2013/186869 | A1 | | 12/2013 |
| WO | 2014049387 | A1 | | 4/2014 |
| WO | 2014106682 | A1 | | 7/2014 |
| WO | 2015056255 | A1 | | 4/2015 |

OTHER PUBLICATIONS

Chinese Office Action dated Mar. 29, 2018 for corresponding Chinese Patent Application No. 201610720966.1.
Chinese Office Action dated Nov. 26, 2018 for corresponding Chinese Patent Application No. 201610720966.1.
EP Office Action dated Oct. 14, 2020 for corresponding European Patent Application No. 16185779.2.
Massachusetts Elevator Code, May 18, 2007, 17.30: Guide Rails; 524 CMR 17.30(3) Table 3, Car Duplex Safeties.

* cited by examiner

| VERTICAL DISTANCE BETWEEN SAFETY | COF DERATING |
|---|---|
| 883 mm | 79% |
| 1500mm | 83% |
| 7000mm | 93% |

SAFETY BRAKE CONFIGURATION FOR ELEVATOR APPLICATION

CROSS REFERENCE TO RELATED APPLICATION

This application claims the benefit of provisional application Ser. No. 62/209,433, filed Aug. 25, 2015.

BACKGROUND

The present disclosure relates to an elevator system and, more particularly, to safety brake configurations therefor.

Elevator systems are typically driven by a motor having a traction sheave, referred to as a machine, which drives ropes or belts that are attached to an elevator cab. The speed and motion of the elevator cab are controlled by a variety of devices throughout the elevator system such as a brake system at the machine to hold the elevator cab during normal operation and as a first response to stop and hold the elevator cab during emergency operation. In addition, safety brakes are utilized as a redundant braking device to stop the cab in the hoistway in the event of an emergency.

Current safety brake configurations utilize duplex, triplex, or quadplex safeties. Duplex safety configurations locate one pair of safeties on the bottom of the cab and one pair of safeties on the top of a single or double deck cab. Triplex and quadplex safety configurations locate two pairs of safeties below the elevator cab and one or two pairs of safeties above the elevator cab. With triplex, quad, or more safeties, the safeties are typically located close together to facilitate packaging.

SUMMARY

An adjacent safety configuration for an elevator according to one disclosed non-limiting embodiment of the present disclosure can include a second safety displaced from a first safety to provide a predetermined time period before the second safety passes over a point on a guide rail previously passed over by the first safety to permit the guide rail surface to decrease in temperature.

A further embodiment of the present disclosure may include, wherein the first safety is leading safeties and the second safety is the trailing safeties when the elevator is travelling downwards.

A further embodiment of any of the embodiments of the present disclosure may include, wherein the second safety is displaced from the first safety by between 1-2 meters.

A further embodiment of any of the embodiments of the present disclosure may include, wherein the second safety is displaced from the first safety by at least 1 meter.

A further embodiment of any of the embodiments of the present disclosure may include, wherein the second safety is displaced from the first safety by at least 0.1 seconds of travel time at a rated speed of the elevator.

A further embodiment of any of the embodiments of the present disclosure may include, wherein the first safety and the second safety are located below an elevator cab.

A further embodiment of any of the embodiments of the present disclosure may include, wherein the first safety and the second safety are located above an elevator cab.

An adjacent safety configuration for an elevator according to another disclosed non-limiting embodiment of the present disclosure can include a second pair of safeties, the second pair of safeties displaced from a first pair of safeties by at least 0.1 seconds of travel time at a rated speed of the elevator.

A further embodiment of any of the embodiments of the present disclosure may include, wherein the first pair of safeties are leading safeties and the second pair of safeties are the trailing safeties.

A further embodiment of any of the embodiments of the present disclosure may include, wherein the second pair of safeties are displaced from the first pair of safeties by between 1-2 meters.

A further embodiment of any of the embodiments of the present disclosure may include, wherein the second pair of safeties are displaced from the first pair of safeties by at least 1 meter.

A further embodiment of any of the embodiments of the present disclosure may include, wherein the first pair of safeties and the second pair of safeties are located below an elevator cab.

A further embodiment of any of the embodiments of the present disclosure may include, wherein the first pair of safeties and the second pair of safeties are located above an elevator cab.

A method of configuring an adjacent safety of an elevator system according to another disclosed non-limiting embodiment of the present disclosure can include de-rating a pair of trailing safeties with respect to a pair of leading safeties as a function of a rated speed of the elevator and a spacing between the pair of trailing safeties and the pair of leading safeties.

A further embodiment of any of the embodiments of the present disclosure may include, wherein the spacing between the pair of trailing safeties and the pair of leading safeties provides at least 0.1 seconds of travel time at the rated speed of the elevator.

A further embodiment of any of the embodiments of the present disclosure may include, wherein de-rating the pair of trailing safeties with respect to the pair of leading safeties includes rating the braking effectiveness of the pair of trailing safeties to be less than the pair of leading safeties.

A further embodiment of any of the embodiments of the present disclosure may include, wherein the second pair of safeties are displaced from the first pair of safeties to provide a predetermined time period before the second pair of safeties pass over a point on a guide rail previously passed over by the first pair of safeties to permit the guide rail surface to decrease by a predetermined temperature.

A further embodiment of any of the embodiments of the present disclosure may include locating the pair of trailing safeties and the pair of leading safeties below the elevator cab, and a third pair of safeties above the elevator cab.

A further embodiment of any of the embodiments of the present disclosure may include locating the pair of trailing safeties and the pair of leading safeties above the elevator cab, and a third pair of safeties below the elevator cab.

The foregoing features and elements may be combined in various combinations without exclusivity, unless expressly indicated otherwise. These features and elements as well as the operation thereof will become more apparent in light of the following description and the accompanying drawings. It should be appreciated, however, the following description and drawings are intended to be exemplary in nature and non-limiting.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
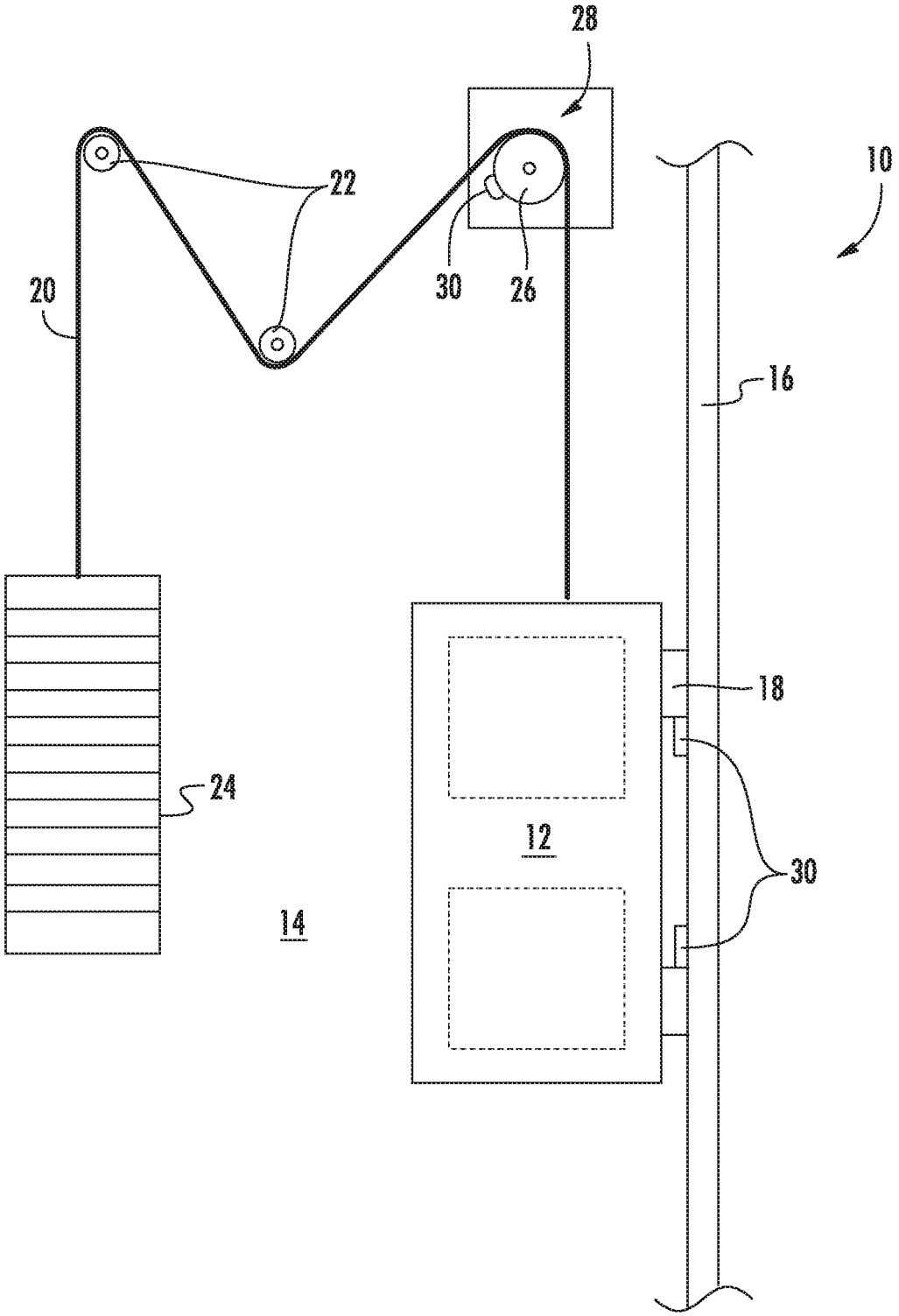
FIG. 1 is a schematic view of an embodiment of an elevator system according to one disclosed non-limiting embodiment.

FIG. 1 schematically illustrates an elevator system 10. The elevator system 10 includes an elevator 12 located in a hoistway 14. The hoistway 14 includes one or more guide rails 16 interactive with one or more guide shoes 18 of the elevator 12 to guide the elevator 12 along the hoistway 14. A suspension member 20, typically a rope and/or a belt, suspends the elevator 12 in the hoistway 14. It should be appreciated that although particular systems are separately defined, each or any of the systems can be otherwise combined or separated via hardware and/or software. It should also be appreciated that although one suspension member 20 is shown, multiple suspension members 20 may be utilized. The suspension member 20 is routed over one or more sheaves 22 thence to a counterweight 24 which may also be disposed in the hoistway 14. One or more of the sheaves may be a drive sheave 26, operably connected to a machine 28 to control the elevator 12 along the hoistway 14.

The elevator system 10 includes a safety brake system 30 disposed, in one embodiment, to engage the guide rails 16 to stop movement of the elevator 12 in response to certain select conditions such as an overspeed or other such situation.

Figure 2:
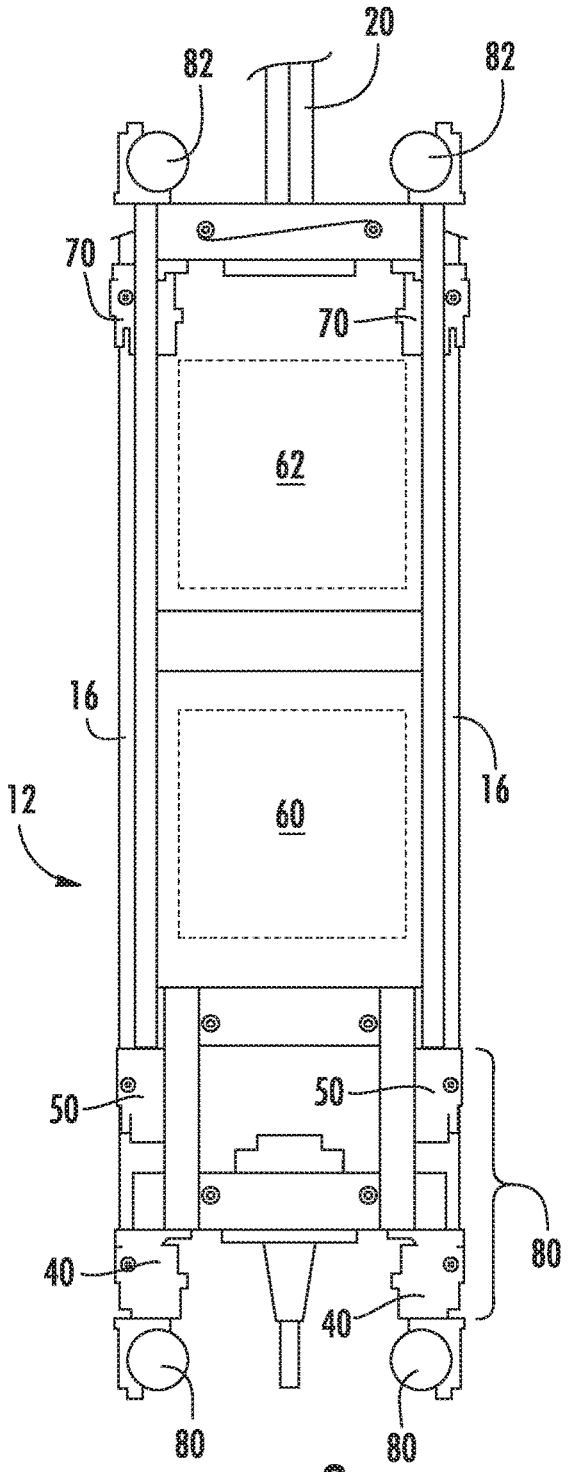
FIG. 2 is a schematic view of an elevator with an adjacent safety configuration of an elevator system according to one disclosed non-limiting embodiment.

With reference to FIG. 2, in one disclosed non-limiting embodiment, the safety brake system 30 includes two pairs of safeties 40, 50 below a lower elevator cab 60 and a third pair of safeties 70 above an upper elevator cab 62 of a double deck elevator. It should be appreciated that although a double deck cab is illustrated, a single deck cab will also benefit herefrom. Further, "leading" and "trailing" are utilized herein with respect to the downward travelling elevator.

Figure 3:
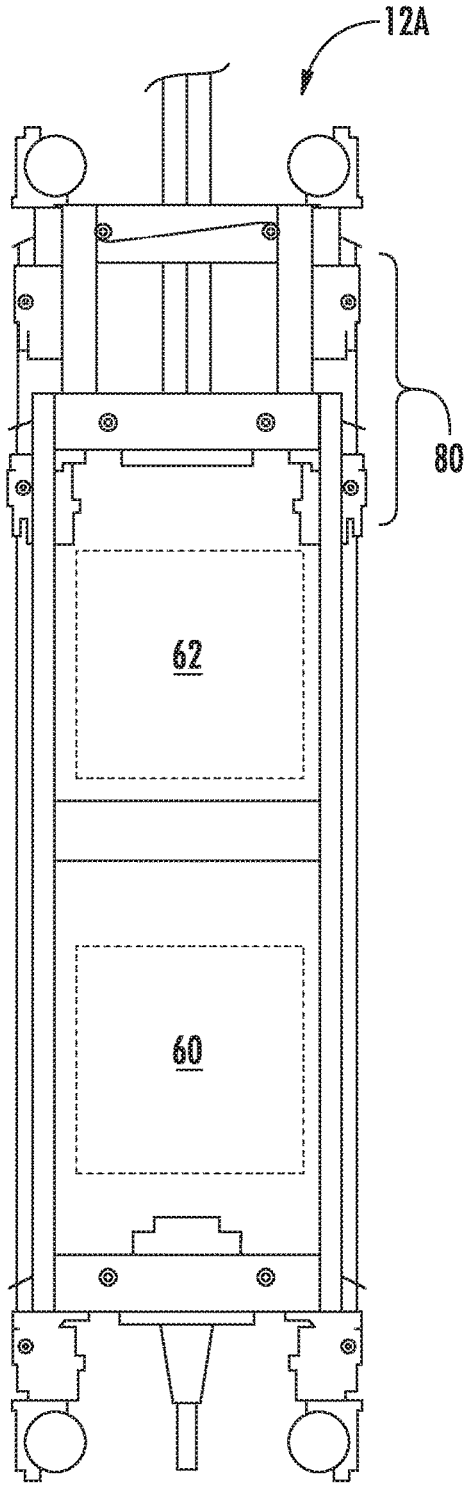
FIG. 3 is a schematic view of an elevator with an adjacent safety configuration of an elevator system according to another disclosed non-limiting embodiment.
Figure 4:
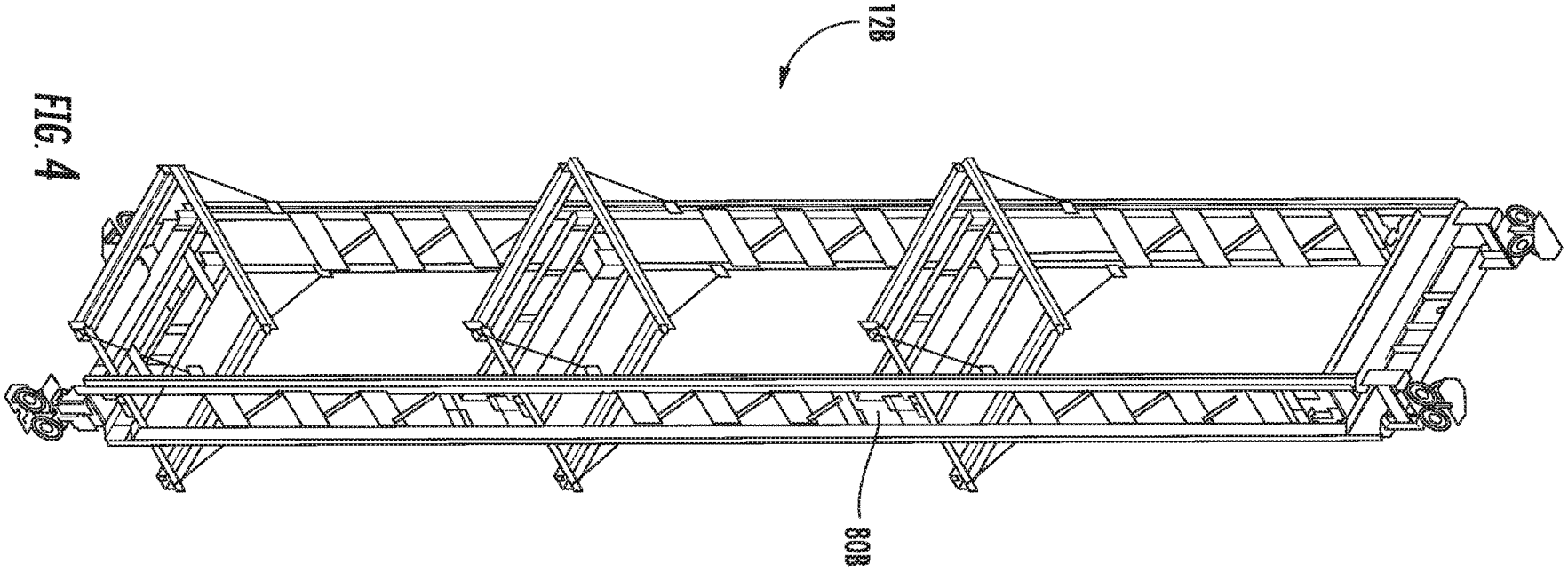
FIG. 4 is a schematic view of an elevator with an adjacent safety configuration of an elevator system according to another disclosed non-limiting embodiment.

The two pairs of safeties 40, 50 may be referred to herein as an adjacent safety configuration 80 as the two pairs of safeties 40, 50 are both located on one side, e.g., below (FIG. 2) or above (80A; FIG. 3), the elevator cab 60, 62. Each safety in each respective pair of safeties 40, 50, 70 engage one of the respective guide rails 16 and are typically located inboard of the respective roller guides 80, 82, i.e., closer to the elevator cab 60, 62. It should be appreciated that other arrangements such as a tripledeck elevator 12B (FIG. 4) with a at least one adjacent safety configuration 80B between cabs 60, 62, 63 will also benefit herefrom.

For relatively high-speed applications, e.g., 10 m/s or more, the trailing safeties 50 of the adjacent safety configuration 80 may exhibit degradation of performance due to operation on the guide rail 16 that has been heated by prior interaction with the leading safeties 40. The degradation of performance due to heating of the guide rail 16 by prior interaction with the leading safeties 40, is minimized by spacing the pair of trailing safeties 50 from the pair of leading safeties 40 to provide a predetermined time period therebetween. The time period permits the guide rail surface to cool subsequent to passage of the leading safeties 40 to improve the effectiveness of the trailing safeties 50. That is, the spacing increases the overall stopping capacity of the safety brake system 30, compared to the conventional close packaging of the safeties.

Figure 5:
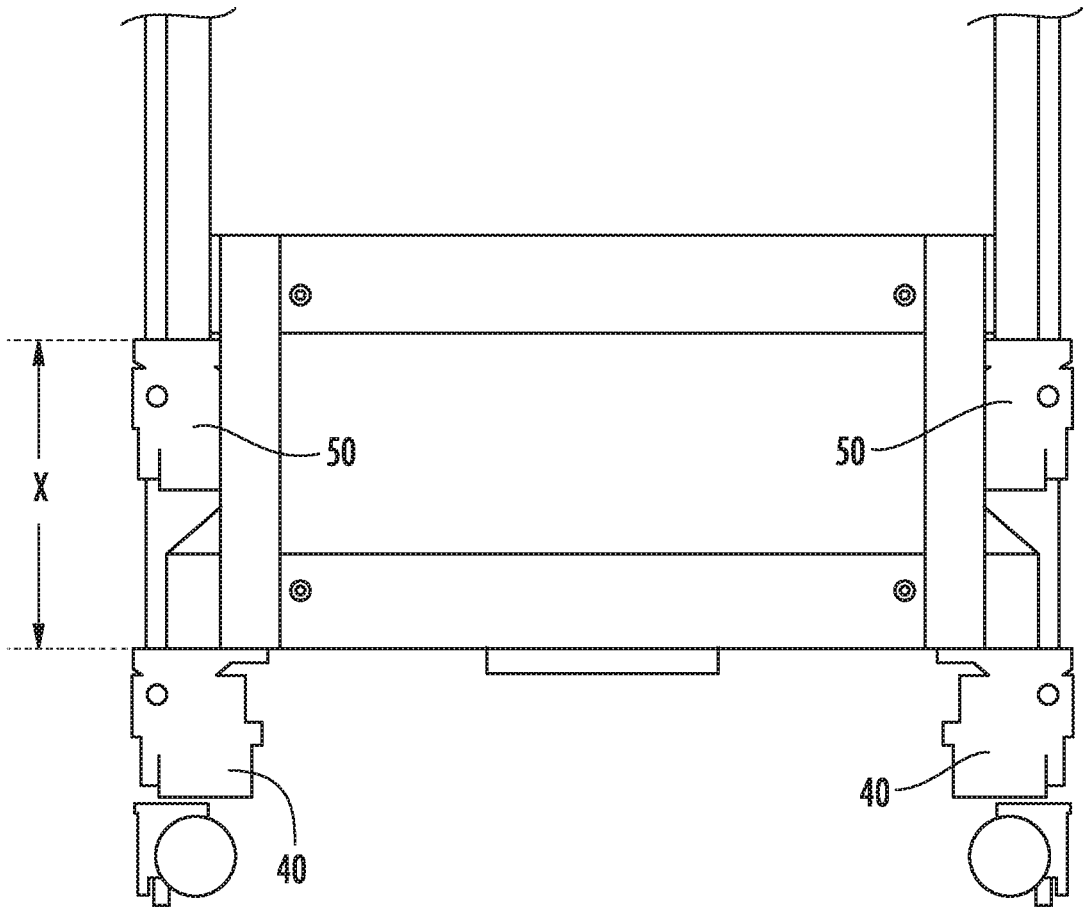
FIG. 5 is a schematic expanded view of an adjacent safety configuration.

In one embodiment, at least 0.1 seconds of travel time is provided between the pair of trailing safeties 50 and the pair of leading safeties 40 at the rated speed of the elevator. In these relatively high-speed embodiments, a distance "X" between the pair of trailing safeties 50 and the pair of leading safeties 40 is between about 1-2 meters (FIG. 5). The trailing safeties 50 thereby contact the same portion of the guide rail 16 only after that portion of the guide rail 16 has been permitted to decrease by a predetermined temperature.

The time period between passage of the pair of leading safeties 40 then the passage of the pair of trailing safeties 50 may alternatively, or additionally, be utilized to de-rate the trailing safeties 50 with respect to the leading safeties 40 as a function of a rated speed of the elevator 12 and the spacing between the safeties 40, 50. That is, the braking capacity of the pair of trailing safeties 50 may be de-rated in the calculation of the overall stopping capacity of the safety brake system 30 since the pair of trailing safeties 50 will be relatively less effective than the leading safeties 40. The spacing between the pair of trailing safeties 50 with respect to the pair of leading safeties 40, and the de-rating of the pair of trailing safeties 50, facilitates the selection, or calibration, of the pair of trailing safeties 50 to achieve a desired capacity for the overall safety brake system 30. For example, the trailing safeties 50 may be selected as a function of elevator speed and spacing to be different than the pair of leading safeties 40 to achieve a desired stop.

Figure 6:
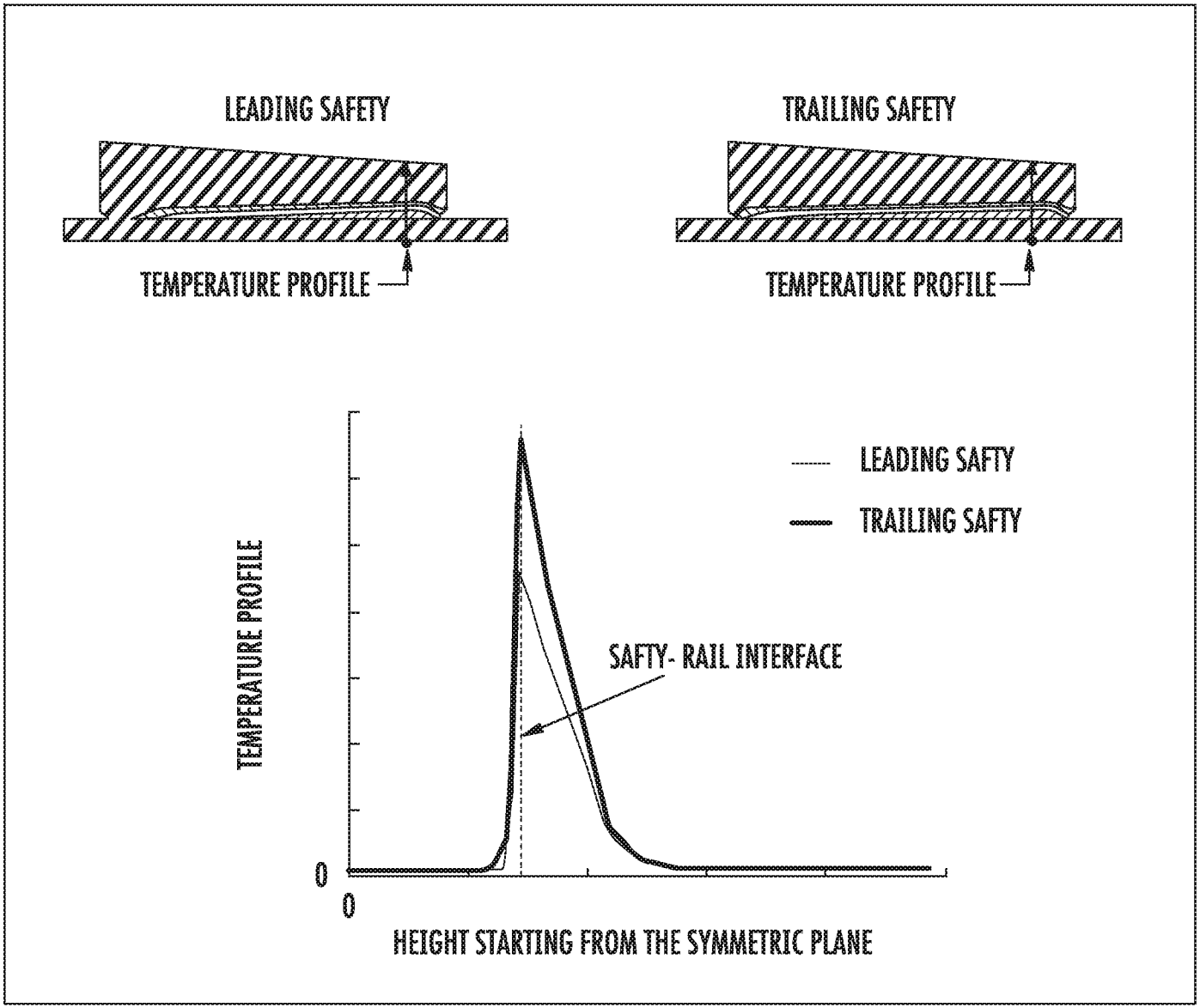
FIG. 6 is a schematic view of a temperature profile for an adjacent safety according to one embodiment.
Figures 7, 8:
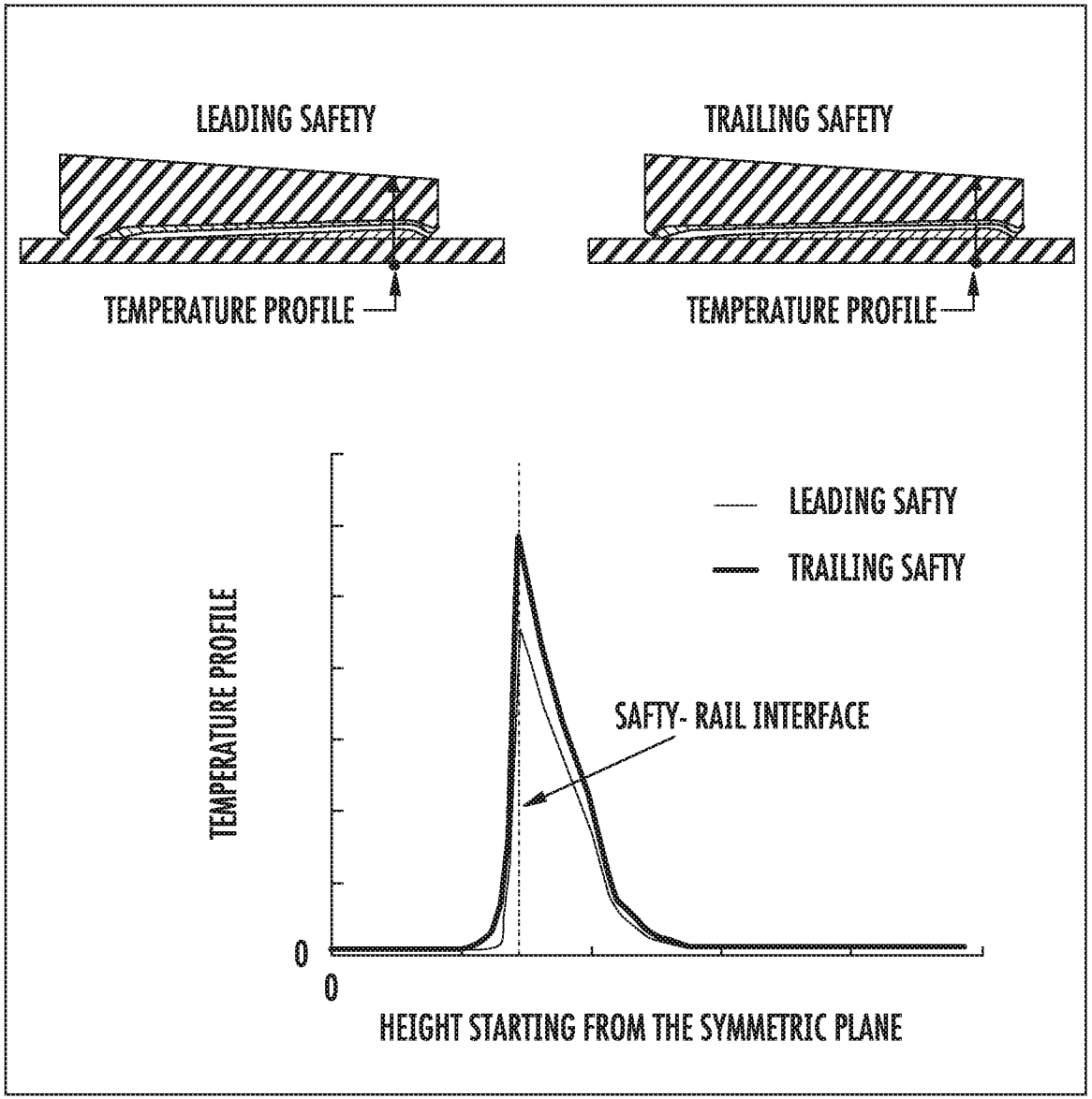
FIG. 7 is a schematic view of a temperature profile for an adjacent safety according to one embodiment.
FIG. 8 is a graphical representation of example spacing between safeties and the Coefficient of friction of brake shoe/guide rail interfaces.

With reference to FIG. 6, in one example in which the leading safeties 40 are spaced from the trailing safeties 50 by 350 mm, a peak temperature difference between the leading safeties 40 and the trailing safeties 50 are relatively greater than when the spacing is increased to 900 mm (FIG. 7). That is, the temperature difference is less pronounced when the spacing is increased. The spacing between the leading safeties 40 from the trailing safeties 50 permits an associated de-rating of a coefficient of friction at the brake/guide rail interface (COF) for the trailing safeties 50 (FIG. 8).

Determination of the relationship between safeties 40, 50 facilitates determination of the overall safety brake system 30 stopping capacity effectiveness to efficiently handle the load in a safe and code compliant system. Further, maximization of the stopping capacity of the safety brake system 30 permits relatively fewer safeties and less weight, or relatively higher capacity elevator cabs.

The use of the terms "a," "an," "the," and similar references in the context of description (especially in the context of the following claims) are to be construed to cover both the singular and the plural, unless otherwise indicated herein or specifically contradicted by context. The modifier "about" used in connection with a quantity is inclusive of the stated value and has the meaning dictated by the context (e.g., it includes the degree of error associated with measurement of the particular quantity). All ranges disclosed herein are inclusive of the endpoints, and the endpoints are independently combinable with each other.

Although the different non-limiting embodiments have specific illustrated components, the embodiments of this invention are not limited to those particular combinations. It is possible to use some of the components or features from any of the non-limiting embodiments in combination with features or components from any of the other non-limiting embodiments.

It should be appreciated that like reference numerals identify corresponding or similar elements throughout the several drawings. It should also be appreciated that although a particular component arrangement is disclosed in the illustrated embodiment, other arrangements will benefit herefrom.

Although particular step sequences are shown, described, and claimed, it should be understood that steps may be performed in any order, separated or combined unless otherwise indicated and will still benefit from the present disclosure.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the disclosure may be practiced other than as specifically described. For that reason the appended claims should be studied to determine true scope and content.

What is claimed is:

1. An adjacent safety brake configuration for an elevator system comprising:

an elevator that is movable at greater than 10 m/s;

a guide rail for the elevator;

a leading safety brake for the elevator, the leading safety brake located inboard of a respective roller guide for the elevator; and a trailing safety brake for the elevator that trails the leading safety brake along the guide rail, the trailing safety brake located inboard of a respective roller guide for the elevator, the leading safety brake and the trailing safety brake both located on one side of the elevator, the trailing safety brake of a braking capacity less than that of the leading safety brake, the trailing safety brake displaced from the leading safety brake on the elevator by between 1-2 meters and at least 0.1 seconds of travel time at a rated speed of the elevator to provide a predetermined time period before the trailing safety brake passes over a reference point on the guide rail previously passed over by the leading safety brake to permit a guide rail surface adjacent to the reference point to decrease in temperature and increase an overall stopping capacity of the adjacent safety brake configuration.

2. The adjacent safety brake configuration as recited in claim 1, wherein the leading safety brake and the trailing safety brake are located below the elevator.

3. The adjacent safety brake configuration as recited in claim 1, wherein the leading safety brake and the trailing safety brake are located above the elevator.

4. An adjacent safety brake configuration for an elevator system comprising:

an elevator that is movable at greater than 10 m/s;

a pair of guide rails for the elevator;

a leading pair of safety brakes for the elevator that ride along the pair of guide rails; and a trailing pair of safety brakes that trails the leading pair of safety brakes along the pair of guide rails, the leading pair of safety brakes and the trailing pair of safety brakes both located on one side of the elevator, the trailing pair of safety brakes displaced from the leading pair of safety brakes by between 1-2 meters and at least 0.1 seconds of travel time at a rated speed of the elevator to provide a predetermined time period before the trailing pair of safety brakes pass over a reference point on each guide rail of the pair of guide rails previously passed over by the leading pair of safety brakes to permit a guide rail surface of each of the pair of guide rails adjacent to the reference point to decrease by a predetermined temperature and increase an overall stopping capacity of the adjacent safety brake configuration; and a third pair of safety brakes on an opposite side of the elevator that ride along the pair of guide rails opposite the leading pair of safety brakes and the trailing pair of safety brakes.

5. The adjacent safety brake configuration as recited in claim 4, wherein the leading pair of safety brakes and the trailing pair of safety brakes are located below the elevator.

6. The adjacent safety configuration as recited in claim 4, wherein the leading pair of safety brakes and the trailing pair of safety brakes are located above the elevator.

7. The adjacent safety brake configuration as recited in claim 4, wherein the braking capacity of the pair of trailing safety brakes are de-rated in the calculation of the overall stopping capacity of the safety brake system such that the pair of trailing safety brakes are relatively less effective than the leading safety brakes.

8. A method of configuring an adjacent safety brake system for an elevator system to reduce degradation of performance due to heating of a guide rail, comprising:

de-rating a braking capacity for the adjacent safety brake system by reducing a braking capacity of a pair of trailing safety brakes with respect to a pair of leading safety brakes of the safety brake system for an elevator that is moving at greater than 10 m/s to achieve a desired capacity for the adjacent safety brake system as a function of a rated speed of the elevator and a spacing between the pair of trailing safety brakes and the pair of leading safety brakes by between 1-2 meters and at least 0.1 seconds of travel time at the rated speed of the elevator, wherein a second pair of safety brakes are displaced from the leading pair of safety brakes to provide a predetermined time period before the trailing pair of safety brakes pass over a reference point on a guide rail previously passed over by the leading pair of safety brakes to permit a guide rail surface adjacent to the reference point to decrease by a predetermined temperature such that the spacing increases an overall stopping capacity of the adjacent safety brake system.

9. The method as recited in claim 8, further comprising locating the pair of trailing safety brakes and the pair of leading safety brakes below the elevator, and a third pair of safety brakes above the elevator.

10. The method as recited in claim 8, further comprising locating the pair of trailing safety brakes and the pair of leading safety brakes above the elevator, and a third pair of safety brakes below the elevator.

* * * * *